United States Patent [19]

Jackson

[11] 4,086,709

[45] May 2, 1978

[54] HOLDER FOR CLOTHES HANGER ON DRIER

[75] Inventor: William Andrew Jackson, Hartford, Mich.

[73] Assignee: Whirlpool Corporation, Benton Harbor, Mich.

[21] Appl. No.: 743,465

[22] Filed: Nov. 19, 1976

[51] Int. Cl.[2] ..... F26B 19/00

[52] U.S. Cl. ..... 34/90; 248/222.2; 248/222.3; 248/536; 34/240

[58] Field of Search ..... 34/90, 243 R, 240, 133, 34/241; 248/535, 536, 205 R, 207, 222.2, 222.3

[56] References Cited

U.S. PATENT DOCUMENTS

| | | | |
|---|---|---|---|
| 1,339,491 | 5/1920 | Axberg | 248/222.2 |
| 1,597,266 | 8/1926 | Dearman | 248/536 |
| 2,558,058 | 6/1951 | Nelson | 248/222.3 |
| 2,983,050 | 5/1961 | Alaback | 34/90 |
| 3,250,235 | 11/1966 | McDonnell | 108/152 |
| 3,278,149 | 10/1966 | Brucker | 248/222.3 |
| 3,313,509 | 4/1967 | Lockert | 248/222.3 |

FOREIGN PATENT DOCUMENTS

| | | | |
|---|---|---|---|
| 391,362 | 12/1973 | U.S.S.R. | 248/222.2 |

*Primary Examiner*—John J. Camby
*Assistant Examiner*—Henry C. Yuen
*Attorney, Agent, or Firm*—Wegner, Stellman, McCord, Wiles & Wood

[57] ABSTRACT

A drier appliance having a cabinet provided with a plurality of outer panels cooperatively defining a vertical slit and an inwardly projecting flange at the top of the slit. A mounting structure is provided for supporting an upright member arranged for removably carrying a hanger. The mounting member includes a carrier arranged for removably carrying the upright member, and a thin wall extending from the carrier and defining a returned hook portion constructed to be passed through the slit to hook onto the cabinet flange for supporting the carrier on the cabinet. A stabilizing structure may be provided on the carrier for stabilizing the carrier on the cabinet. The stabilizing structure may be formed as a second thin wall on the carrier spaced from the first thin wall and adapted to be received in the cabinet slit. Locking structure may be provided on the thin walls for releasably locking the thin walls to the cabinet portions defining the slit.

9 Claims, 5 Drawing Figures

HOLDER FOR CLOTHES HANGER ON DRIER

BACKGROUND OF THE INVENTION

1. Field of the Invention

This invention relates to clothes driers and in particular to means for mounting a holder for clothes hangers on a drier.

2. Description of the Prior Art

In U.S. Pat. No. 2,983,050 of Glenn James Alaback, owned by the assignee hereof, a combined room warmer and clothes drier is illustrated having a rack supported on a rod to carry clothes to be dried in a drying zone externally of the cabinet. The air leaving the drier flows through the garments on the rack and then continues into the room to heat the room. The rack is adjustably carried on a bracket secured to the back of the control panel of the drier and to the cabinet cover by sheet metal screws. The rack is mounted to a vertical rod slidably received in the bracket and the bracket is provided with a positioning clip.

Another form of supporting bracket is illustrated in U.S. Pat. No. 2,241,657 of Herbert C. Dehring. As shown therein, the supporting bracket comprises a T-shaped stamping having substantially right angle sections and a depending member provided with lugs for securing the dependent member between a mopboard and a wall.

William A. Erdon et al, in U.S. Pat. No. 2,664,634, show a position indicator for automobiles including a bracket having a thin, flat member curved at one edge to substantially the curvature of a fender opening and slotted to engage one of the fasteners securing the mount to the fender. Inturned flanges are disposed on the margin of the curved portion of the bracket member for engaging the edge of the opening in the fender. The bracket is held firmly in position by the screws or bolts used to secure the headlight mount in place.

In U.S. Pat. No. 3,250,235, of Thomas M. McDonnell, a display device is illustrated including a mounting bracket of U-shaped construction having turned upper lugs and rearwardly projecting lower lugs received in suitable openings in a mounting panel for removably retaining the bracket in any one of a plurality of different positions on the panel.

SUMMARY OF THE INVENTION

The present invention comprehends an improved mounting means for supporting an upright member on a drier appliance for removably carrying a hanger. The mounting means is adapted for use with a conventional drier appliance having a cabinet provided with a plurality of outer panels cooperatively defining a vertical slit and an inwardly projecting flange at the top of the slit. The mounting means includes a carrier having means for removably carrying the upright member and a thin wall extending from the carrier and defining a returned hook portion constructed to be passed through the slit to hook onto the cabinet flange for supporting the carrier on the cabinet.

Means may be further provided on the carrier for stabilizing the carrier when mounted on the drier cabinet. In the illustrated embodiment, the stabilizing means comprises a second thin wall extending from the carrier and spaced from the first thin wall for reception in the cabinet slit.

The thin wall portions of the mounting means may be parallel and, in one form, may be coplanar.

The carrier may define a socket for receiving the upright member. In one form, the carrier comprises a split tubular member. The thin wall means may extend integrally from one longitudinal edge of the split tubular member and where the stabilizing means is utilized, the first named thin wall means may extend from one edge thereof and the stabilizing thin wall means may extend from the opposite edge. Locking elements may be provided on the thin wall means for releasably locking them to the portions of the cabinet defining the sides of the slit. Similar locking means may be provided on the socket portion of the carrier for releasably locking the upright member to the carrier.

The improved mounting means of the present invention is extremely simple and economical of construction and permits a facilitated installation of a convenience hanger on a conventional clothes drier. The structure may be readily installed and removed from the drier as desired so that the drier may be utilized either with or without the convenience hanger by simple manipulation of the hanger structure without need for tools. The mounting means synergistically utilizes portions of the conventional cabinet structure for cooperation therewith in retaining the mounting means removably on the drier.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figure 2:
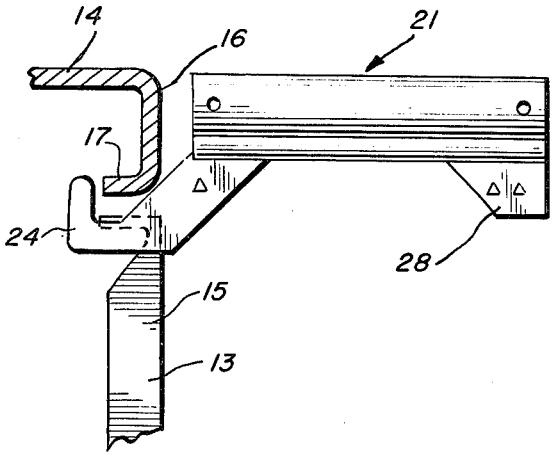
FIG. 2 is a side elevation of the mounting bracket as disposed in a first step in the installation of the mounting bracket on the drier, the drier structure being shown in vertical section.

In the illustrative embodiment of the invention as disclosed in the drawing, an appliance generally designated 10 comprises a clothes drier having an outer cabinet 11 including a side panel 12, a front panel 13, and a top panel 14. The side and front panels cooperatively define a vertical slit 15. Top panel 14 defines an outer edge 16 including a distal returned flange 17. As shown in FIG. 2, flange 17 overlies the top of the slit 15.

Figure 1:
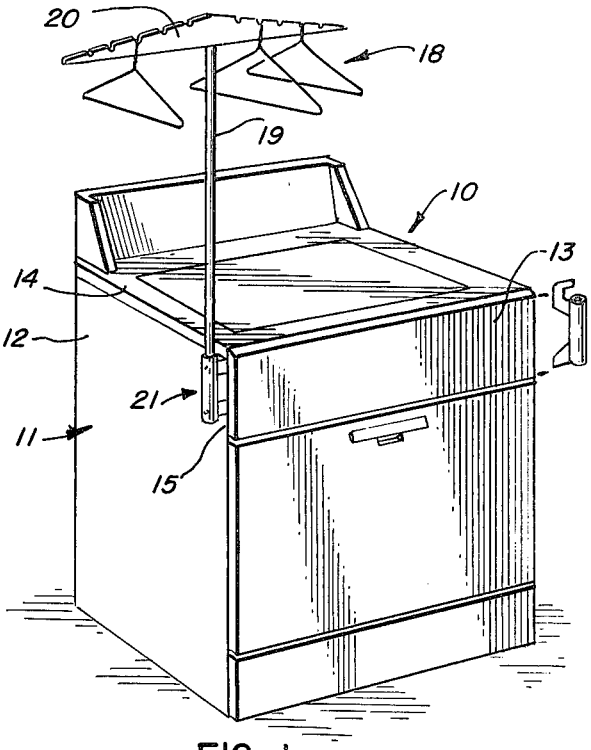
FIG. 1 is a perspective view of a clothes drier provided with a convenience hanger embodying the invention with a mounting bracket of a sound convenience hanger being illustrated as removed from association with the cabinet.

The present invention is concerned with the provision of a convenience hanger generally designated 18 to be removably installed on the drier cabinet. The convenience hanger includes an upright member 19, an upper hanger arm 20, and a mounting means bracket generally designated 21. As shown in FIG. 1, in the installed arrangement, bracket 21 is secured to the drier cabinet with the upright member 19 extending upwardly therefrom and supporting at its upper end the hanger arm 20 for supporting in turn a plurality of clothes hangers or the like above the top wall 14 of the cabinet.

Figure 4:
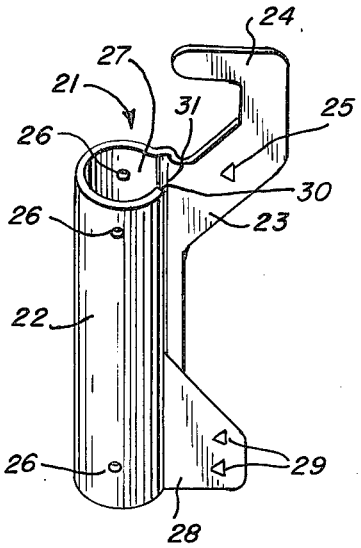
FIG. 4 is a perspective view of the bracket.

Upright member 19 may comprise a conventional support tube and the invention comprehends the provision of an improved bracket means 21 for removably supporting the tube on the cabinet. As shown in FIG. 4, the bracket 21 includes a tubular carrier portion 22 for receiving the lower end of the upright member 19. At its upper end, the carrier 22 is provided with a thin wall portion 23 extending outwardly from the tubular portion 22 and defining a returned hook 24 at its distal end. The plane of the wall portion 23 is preferably parallel to the axis of the tubular portion 22 and the returned hook 24 may extend substantially radially thereto. Thin wall 23 may be provided with a locking means 25 in the form of a tang projecting from the thin wall. Tubular portion 22 may be provided with a plurality of locking means in the form of tangs 26 projecting inwardly into the tubular socket 27 defined by the carrier tubular portion 22.

In the illustrated embodiment, a stabilizing means may be provided on the carrier 22 in the form of a second thin wall 28 projecting outwardly from the lower end of the carrier. In the illustrated embodiment of FIG. 4, thin wall 28 is parallel to thin wall 23. Thin wall 28 may be provided with one or more locking elements defined by projecting tangs 29.

As shown in FIG. 4, the tubular carrier 22 may comprise a split tubular element defining a pair of opposed longitudinally extending edge portions 30 and 31. Thin wall 23 may extend from edge 31 and thin wall 28 may extend from edge 30 as unitary integral extensions of the tubular carrier 22. In the illustrated embodiment, the bracket 21 comprises a stamped and formed unitary metal element.

Figure 3:
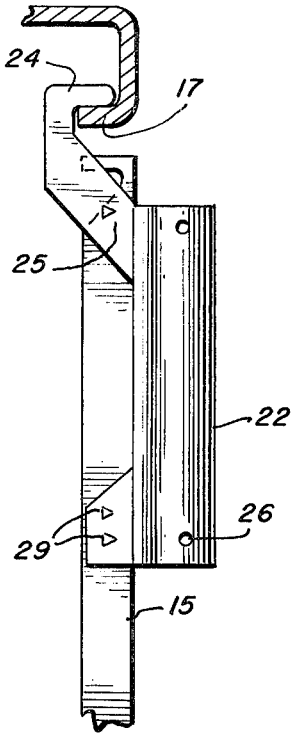
FIG. 3 is a view similar to that of FIG. 2 with the bracket in the installed disposition.

The installation of the bracket 21 on the cabinet 11 is extremely simple. As illustrated in FIGS. 2 and 3, the bracket is installed by firstly passing the hook portion 24 through the slit 15 to dispose the hook portion inwardly of the top wall flange 17.

The bracket is then swung in a clockwise direction from the position of FIG. 2 to pass the lower wall portion 28 through the slit 15 and bring the hook portion 24 into overlying relationship with the top wall flange 17. In the inserted arrangement of the bracket, as illustrated in FIG. 3, the tangs 25 and 29 engage the portions of the cabinet defining the slit 15 so as to provide a releasable lock of the bracket to the cabinet, with the bracket being primarily supported by the engagement of hook 24 on the cabinet flange 17 and carrying the weight of the hanger structure.

The upright member 19 may be installed in the socket 27 of the bracket to complete the installation of the convenience hanger 18 on the drier as illustrated in FIG. 1.

Disassembly of the convenience hanger from the drier is similarly extremely simple, being effected by reverse procedure from that described as relative to the mounting of the hanger on the drier.

The slight spacing of the thin walls 23 and 28 by the mounting thereof on the opposite edges of the split tubular carrier 22 provides a resilient frictional retention of the thin walls within the slit.

Further as shown in FIG. 4, edge 31 of the tubular carrier may comprise an offset portion to allow for slight panel misalignment in the cabinet construction.

To set the tangs 25 and 29 in the confronting panel flanges, the bracket may be struck with the palm of the user's hand when in the arrangement of FIG. 3. Such setting of the tangs effectively locks the bracket to the cabinet while yet permits release of the bracket therefrom when desired.

Figure 5:
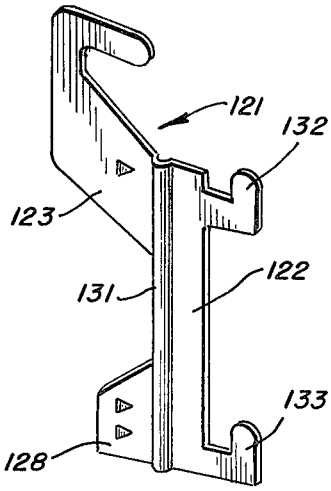
FIG. 5 is a perspective view of a modified form of the mounting means bracket embodying the invention.

A modified form of bracket embodying the invention comprises bracket 121 shown in FIG. 5, wherein the carrier portion 122 is defined by a flat wall provided with upper and lower upturned hooks 132 and 133 for cooperating with a suitable channel-type upright member (not shown). The stabilizing thin wall 128 and the support thin wall 123 may be effectively coplanar extending oppositely from an offset edge 131 of the carrier. The modified bracket of FIG. 5 illustrates one modified form of carrier means adapted for use with an upright member of different construction from upright member 19. As will be obvious to those skilled in the art, other suitable carrier portion configurations may be utilized within the scope of the invention for use with other forms of upright member securing means.

As further illustrated in FIG. 1, the bracket mounting means herein may be utilized interchangeably at the left or right side of the drier. The invention is advantageous in requiring no modification of conventional drier cabinet construction while utilizing a portion of the cabinet construction which is readily available for use in cooperation with the bracket structure while yet being hidden at all times. While the mounting of the bracket to the cabinet is extremely simple, the mounting is effective to retain the convenience hanger in position on the drier notwithstanding substantial vibration of the drier cabinet as during conventional drier operation.

Where it is desired to retain the bracket on the cabinet, the upright member 19 may be readily removed therefrom so that successive installation and removal operations may be effected with the bracket retained in place.

In the illustrated embodiment, the bracket metal may comprise spring steel to provide further improved removable retention of the bracket on the cabinet in the installed arrangement.

The foregoing disclosure of specific embodiments is illustrative of the broad inventive concepts comprehended by the invention.

The embodiments of the invention in which an exclusive property of privilege is claimed are defined as follows:

1. In an appliance having a cabinet provided with a plurality of outer panels cooperatively defining a vertical slit and an inwardly projecting flange at the top of the slit, improved mounting means for supporting an upright member having means for removably carrying a hanger, said mounting means comprising a carrier having split tubular support means for removably carrying the upright member, a first thin wall portion extending from one longitudinal split edge of said carrier support means and defining a returned hook portion constructed to be passed through said slit to hook onto said cabinet flange for supporting the carrier on the cabinet and a second thin wall portion extending from the other longitudinal split edge of said carrier support means and substantially coplanarly of said first thin wall portion to be received in said slit for stabilizing the carrier on said cabinet.

2. The appliance structure of claim 1 wherein said carrier defines a socket receiving said upright member.

3. The appliance structure of claim 1 wherein said carrier support means defines a socket receiving said upright member and having locking means projecting into said socket for releasably locking said upright member thereon.

4. The appliance structure of claim 1 wherein said carrier and thin wall portions are unitarily integral.

5. The appliance structure of claim 1 wherein said thin wall portions are provided with locking means projecting laterally therefrom for releasably locking said thin wall portions to the cabinet at the sides of said slit.

6. The appliance structure of claim 1 wherein said thin wall portions are at vertically opposite ends of said carrier.

7. In an appliance having a cabinet provided with a plurality of outer panels cooperatively defining a vertical slit and an inwardly projecting flange at the top of the slit, improved mounting means for supporting an upright member having means for removably carrying a hanger, said mounting means comprising a carrier having split tubular support means for removably carrying the upright member, a first thin wall portion extending from one longitudinal split edge of said carrier support means and defining a returned hook portion constructed to be passed through said slit to hook onto said cabinet flange for supporting the carrier on the cabinet and a second thin wall portion extending from the other longitudinal split edge of said carrier support means and slightly spaced substantially parallel to said first thin wall portion to be received in said slit for stabilizing the carrier on said cabinet, the slight spacing of said thin wall portions on said support means edges providing resilient frictional retention of the thin wall portions within said slit.

8. The appliance structure of claim 7 wherein at least one of said thin wall portions are provided with locking means projecting laterally therefrom for releasably locking engagement with the cabinet at at least one of the sides of said slit.

9. The appliance structure of claim 7 wherein said appliance comprises a clothes drier and said hanger comprises a horizontal arm adapted to carry removably a plurality of clothes hangers in spaced relationship.

* * * * *